US005507714A

United States Patent [19]

Furuta et al.

[11] Patent Number: 5,507,714

[45] Date of Patent: Apr. 16, 1996

[54] APPARATUS FOR ADJUSTING JAW GAP OF JAW CYLINDER FOR FOLDER

[75] Inventors: Eiji Furuta; Satoshi Matsushima, both of Mihara, Japan

[73] Assignee: Mitsubishi Jukogyo Kabushiki Kaisha, Tokyo, Japan

[21] Appl. No.: 262,889

[22] Filed: Jun. 21, 1994

[30] Foreign Application Priority Data

Aug. 31, 1993 [JP] Japan ..... 5-216065

[51] Int. Cl.[6] ..... B42C 1/00; B42C 1/04; B65H 29/06; B65H 37/06

[52] U.S. Cl. ..... 493/475; 493/471; 493/424; 493/476

[58] Field of Search ..... 493/424, 425, 493/426, 427, 428, 429, 432, 471, 475, 476

[56] References Cited

U.S. PATENT DOCUMENTS

| | | | |
|---|---|---|---|
| 4,380,449 | 4/1983 | Michalik | 493/424 |
| 4,778,166 | 10/1988 | Nanba | 493/428 |
| 5,057,064 | 10/1991 | Michalik | 493/476 |
| 5,096,175 | 3/1992 | Lange | 493/425 |
| 5,201,701 | 4/1993 | Roettger | 493/425 |
| 5,215,014 | 6/1993 | Burger | 493/424 |
| 5,417,642 | 5/1995 | Boronka | 493/425 |

*Primary Examiner*—Jack W. Lavinder
*Assistant Examiner*—Christopher W. Day
*Attorney, Agent, or Firm*—Wenderoth, Lind & Ponack

[57] ABSTRACT

A jaw cylinder 30 includes a jaw cylinder body 31 and a folding jaw support 36 rotatably supported with respect to the jaw cylinder body 31, and two folding jaws 11 and 15 are attached to the jaw cylinder body 31 or the jaw cylinder support 36, respectively. The folding jaw 11 is rotated with respect to the folding jaw 15 so as to adjust a gap between the folding jaws 11 and 15 in accordance with the thickness of a product. At this time, a jaw cylinder driving helical gear 38 and a gap adjusting helical gear 39 are moved in an axial direction thereof by an adjusting unit 43 so that the jaw cylinder driving helical gear 38 or a folding cylinder driving helical gear 25 meshing with the helical gear 38 are rotated in a circumferential direction. On the other hand, a support rotating helical gear 37 is rotated in the circumferential direction through the gap adjusting helical gear 39 and intermediate gears 40 and 41 by an amount larger than a rotating amount of said jaw cylinder driving helical gear 38 or the folding cylinder driving helical gear 25.

4 Claims, 3 Drawing Sheets

APPARATUS FOR ADJUSTING JAW GAP OF JAW CYLINDER FOR FOLDER

BACKGROUND OF THE INVENTION

1. Field of the Invention

The present invention relates to an apparatus for adjusting a jaw gap of a jaw cylinder for a folder, which adjusts a gap between a pair of folding jaws provided in a jaw cylinder in accordance with a thickness determined by a product thickness and a pagination.

2. Discussion of the Related Art

A conventional apparatus for adjusting a jaw gap of a jaw cylinder for a folder, which is disclosed by Japanese Patent Unexamined Publication No. Hei 4-223973), will be described with reference to FIGS. 3 and 4. In the figures, reference numerals 1*a* and 1*b* denote a pair of frames of the folder; 2, a folding cylinder shaft of which is rotatably supported by the frames 1*a* and 1*b*. Reference numeral 3 denotes a jaw cylinder; 4, a shaft of the jaw cylinder 3; 4*a*, two flanges provided in the shaft 4 which is rotatably supported by the frames 1*a* and 1*b*.

Reference numeral 5 denotes a jaw cylinder driving helical gear fitted to a left end portion of the shaft 4 of the jaw cylinder 3; 25, a folding cylinder driving helical gear fitted to a left end portion of the shaft of the folding cylinder 2. The folding cylinder driving helical gear 25 and the jaw cylinder driving helical gear 5 mesh with each other so as to be driven.

Reference numeral 6 denotes a stepped bush movably fitted to the shaft 4 of the jaw cylinder 3; 7, a gap adjusting helical gear fixed to a left end portion of the stepped bush 6; 8, an inverse gear fixed to a right end side of the stepped bush 6; 23, a helical gear meshing with the jaw cylinder driving helical gear 5; and 22, a helical gear meshing with the gap adjusting helical gear 7.

Reference numeral 14 denotes a folding jaw support movably fitted to the shaft 4 between the respective flanges 4*a*; 13, two gears fixed to the folding jaw support 14; and 10, other folding jaw supports whose left side support is fixed to the stepped bush 6 and whose right side support movably fitted to the shaft 4 of the jaw cylinder 3. Reference symbols a and b denote coaxial gears rotatably fitted to the respective flanges 4*a*; and c, gears rotatably fitted to the respective flanges 4*a*. The gears c mesh with the gear b and the gear 13.

Reference numeral 11' denotes levers swingably fitted to the right and left folding jaw supports 10; 11, movable jaws fixed to the levers 11' through a key 100; and 15, stationary jaws fixed to the folding jaw support 14.

Reference numeral 16 denotes a motor; 17, a threaded portion provided on an output shaft end of the motor 16; 19, a cylindrical body; and 18, a nut provided on the cylindrical body 19 in such a manner that the nut 18 is screwed to the threaded portion 17. Reference numeral 20 is a protrusion provided in an inner surface of the cylindrical body 19; and 21, a shaft attached to the frame 1*a*. A groove formed in the shaft 21 in the axial direction thereof engages with the protrusion 20. Reference numeral 22 denotes a helical gear rotatably supported by the cylindrical body 19; and 23, a helical gear attached to the helical gear 22.

The jaw cylinder 3 includes the above-mentioned parts 4 to 15. Reference numeral 9 denotes a jaw gap adjusting unit which is constituted by the above-mentioned parts 16 to 23, and 12 is a rotational direction reverse transmission unit which is constituted by the above-mentioned gears a to c.

The operation of the apparatus for adjusting the jaw gap of the jaw cylinder shown in FIGS. 3 and 4 will be described. When adjusting the gap between the folding jaws 11 and 15 of the jaw cylinder 3, the motor 16 of the jaw gap adjusting unit 9 is driven to make the threaded portion 17 rotate such that the nut 18, the cylindrical body 19 and the helical gear 22 are moved in the axial direction (in the direction of an arrow A) thereby to allow the gap adjusting helical gear 7 to rotate in the circumferential direction with respect to the jaw cylinder driving helical gear 5.

Also, the rotational movement of the gap adjusting helical gear 7 is transmitted to the stepped bush 6 and the right side of the folding jaw 10 so that the folding jaw 11 which is swingable by an open/close unit (refer to FIG. 1) rotates clockwise with respect to a folding blade 24 of the jaw cylinder 2 as shown in FIG. 4.

Further, the rotational movements of the gap adjusting helical gear 7 and the stepped bush 6 are transmitted to the inverse gear 8, and the rotational movement of the inverse gear 8 is then transmitted to the folding jaw support 14 through the gears a, b and c of the rotational direction reverse transmission unit 12 and the gear 13, whereby the rotational jaw 15 rotates counterclockwise with respect to the folding blade 24 as shown in FIG. 4.

With the above-mentioned operation, the gap between the folding jaws 11 and 15 of the jaw cylinder 3 is adjusted.

In the above-mentioned conventional apparatus for adjusting the jaw gap of the jaw cylinder for the folder shown in FIGS. 3 and 4, since the rotational direction reverse transmission unit 12 having a large number of parts is disposed within the jaw cylinder 3, the structure of the jaw cylinder 3 is made complicated and the costs are increased. Further, since the rotational direction reverse transmission unit 12 is disposed within the jaw cylinder 3, the width of the jaw cylinder 3 is lengthened, a gap between the frames 1*a* and 1*b* are widened, and the entire folder is made large in size to require a large installation space, resulting in such a problem that the costs are increased.

SUMMARY OF THE INVENTION

The present invention has been made in view of the above-mentioned problems, and an object of the present invention is to provide an apparatus for adjusting a jaw gap of a jaw cylinder for a folder which is capable of reducing the costs and saving the folder installation space.

In order to achieve the above-mentioned object, the present invention provides an apparatus for adjusting a jaw gap of a jaw cylinder for a folder in which a folding blade of a folding cylinder is inserted between a pair of folding jaws provided in a jaw cylinder to doubly fold folding products held on an outer peripheral surface of the folding cylinder, comprising a folding jaw support provided concentrically with respect to an axis of the jaw cylinder, one of the pair of folding jaws being provided on the folding jaw support, and the other of the pair of folding jaws being provided on the jaw cylinder body.

Further, a jaw cylinder driving helical gear is fitted to the shaft of the jaw cylinder so as to be movable in an axial direction thereof but non-rotatable, and a gap adjusting helical gear having a helical edge with the same direction of a twist angle as and the twist angle larger than those of the jaw cylinder driving helical gear is fitted to the jaw cylinder driving helical gear, and the gap adjusting helical gear is coupled with a support rotating helical gear fitted to the folding jaw support through intermediate gears to provide an adjusting unit in a fixed side member of the folder for moving the jaw cylinder driving helical gear in the axial direction.

With the above-mentioned structure, in the apparatus for adjusting the jaw gap of the jaw cylinder for the folder in accordance with the present invention, one folding jaw is rotated with respect to the other folding jaw thereby to adjust the gap between these folding jaws according to a product thickness. At this time, the adjusting unit makes the jaw cylinder driving helical gear and the gap adjusting helical gear move in the axial direction so that the jaw cylinder driving helical gear or a folding cylinder driving helical gear meshing with the jaw cylinder driving helical gear is rotated in the circumferential direction in accordance with the twist angle of these helical gears, while the support rotating helical gear is rotated through the gap adjusting helical gear and the intermediate gears in the circumferential direction by an amount larger than a rotating amount of the jaw cylinder driving helical gear or the folding cylinder driving helical gear.

BRIEF DESCRIPTION OF THE DRAWINGS

The accompanying drawings, which are incorporated in and constitute a part of this specification, illustrate embodiments of the invention, and together with the description, serve to explain the objects, advantages and principles of the invention. In the drawings.

FIGS. 2(*b*) and 2(*c*) show diagrams used for explaining the operation of the apparatus of FIG. 1, respectively;

DETAILED DESCRIPTION OF THE PREFERRED EMBODIMENTS

Now, an apparatus for adjusting a jaw gap of a jaw cylinder for a folder in accordance with the present invention will be described with reference to an embodiment shown in FIGS. 1 and 2.

Figure 1:
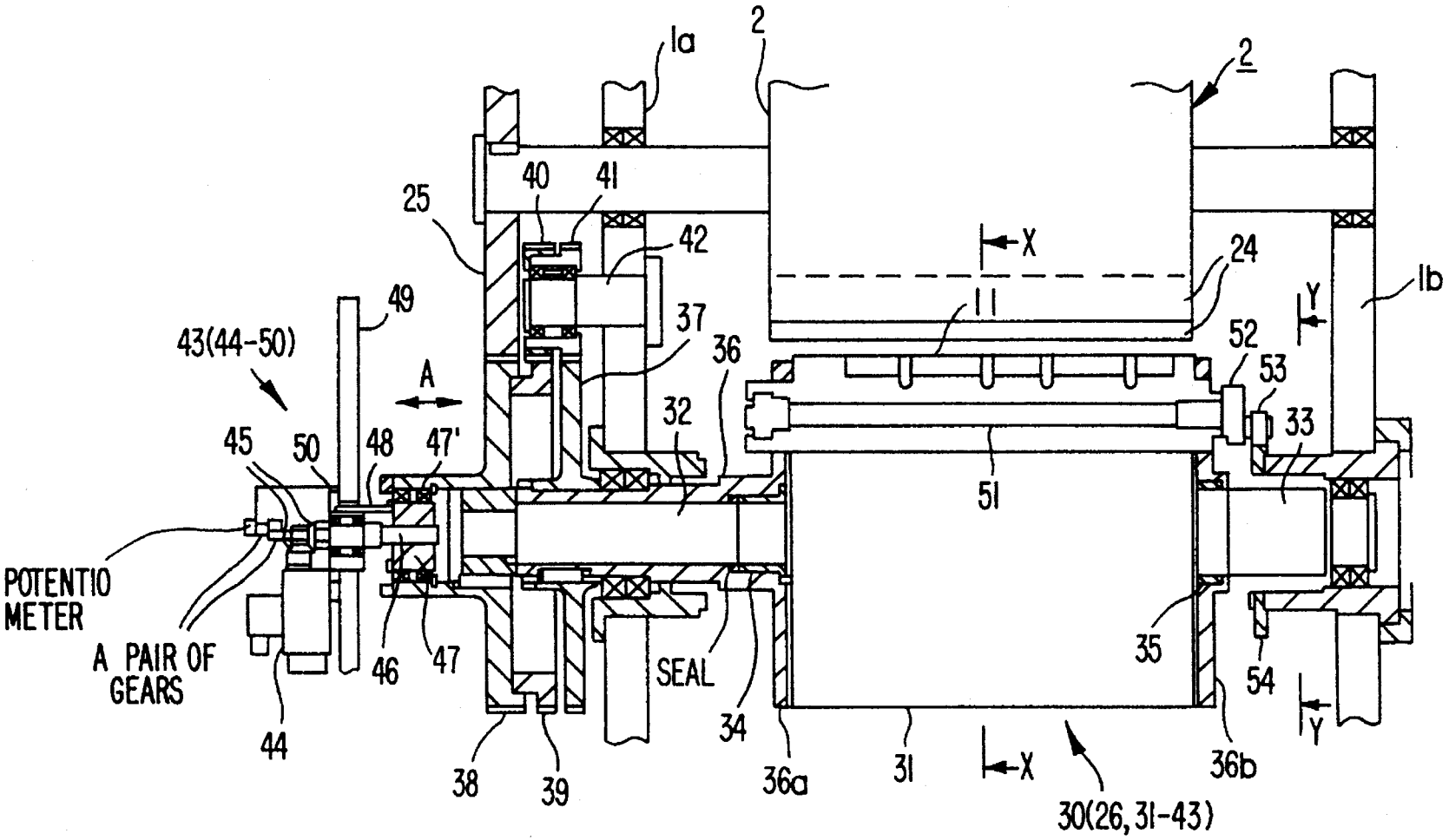
FIG. 1 is a longitudinally sectional front view showing an apparatus for adjusting a jaw gap of a jaw cylinder for a folder in accordance with an embodiment of the present invention.

In FIG. 1, reference numerals 1*a* and 1*b* denote a pair of frames in a folder, and 2 denotes a folding cylinder an axis of which is rotatably supported by these frames 1*a* and 1*b*. In FIGS. 1, 2(*a*), 2(*b*) and 2(*c*), reference numeral 24 denotes a folding blade of the folding cylinder 2, and 25 denotes a folding cylinder driving helical gear attached to the shaft of the folding cylinder 2.

Figure 2A:
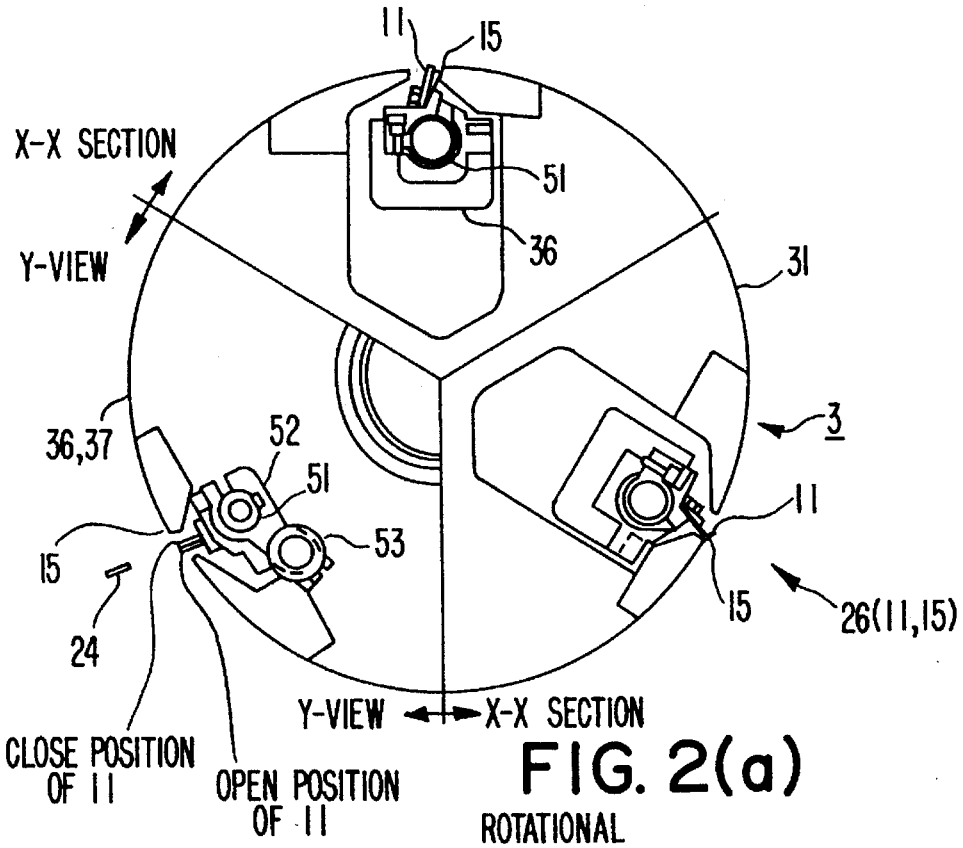
FIG. 2(*a*) is a longitudinally sectional side view showing the apparatus of FIG. 1, in which an upper portion and a right-sided lower portion thereof are longitudinal-sectional side views taken along a line X—X in FIG. 1, and a left-sided lower portion thereof is a longitudinal-sectional side view taken along a line Y—Y therein.
Figure 2B:
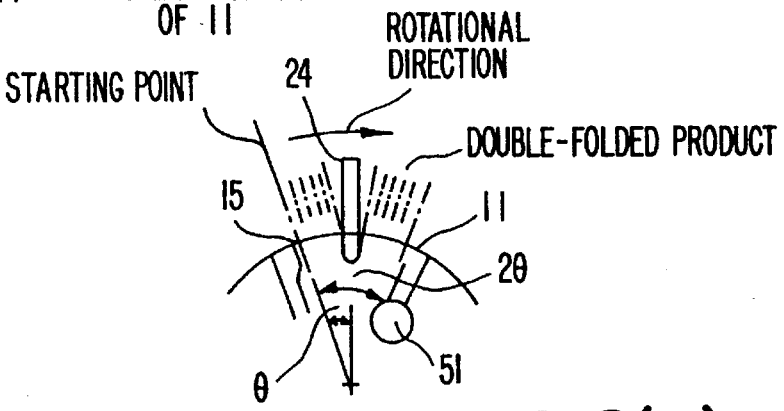
Figure 2C:
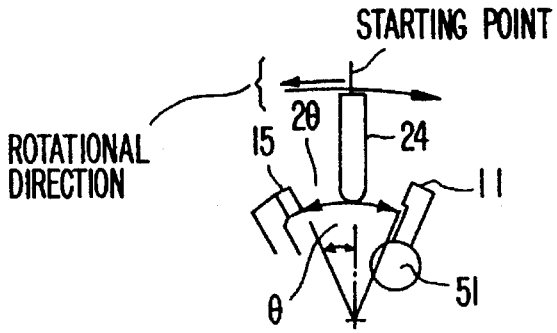
Figure 4:
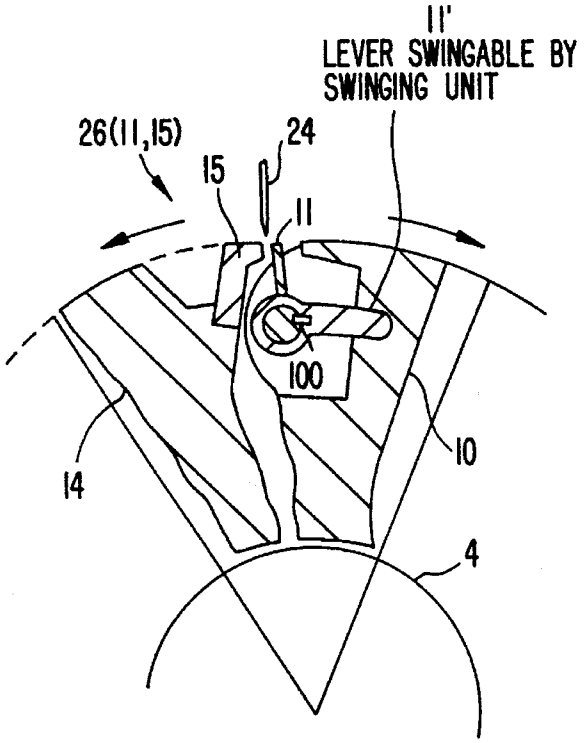
FIG. 4 (PRIOR ART)
FIG. 4 is a longitudinally sectional side view showing a partially enlarged portion of the conventional apparatus shown in FIG. 3.
Figure 3:
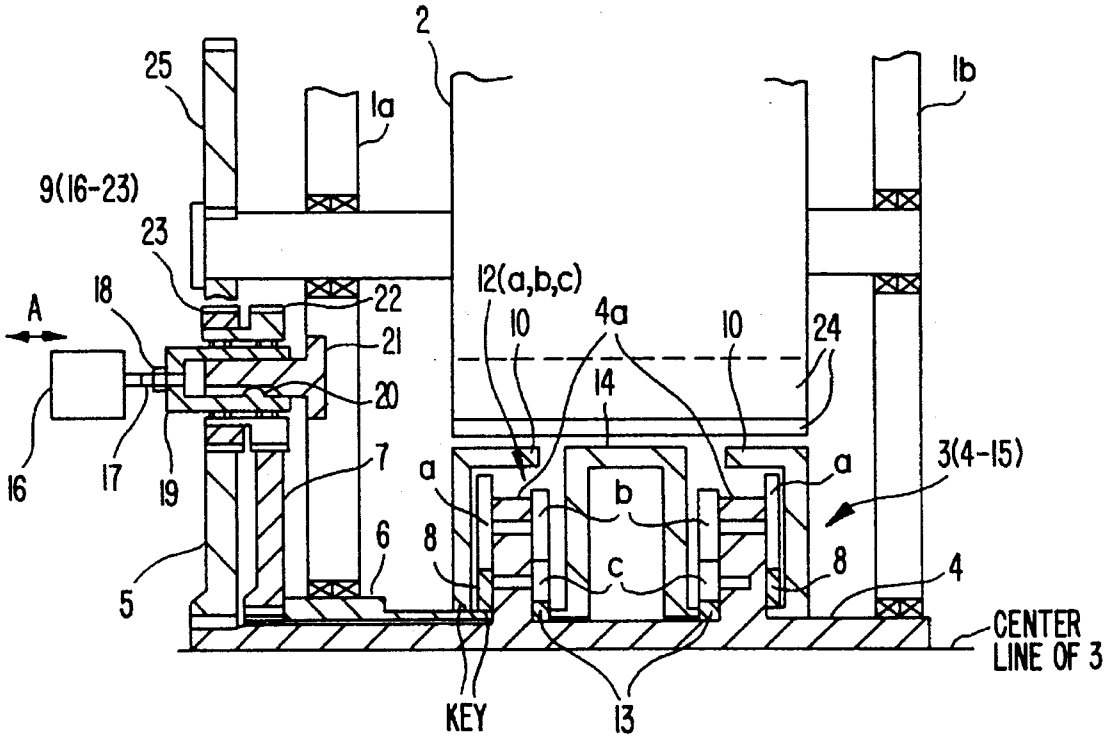
FIG. 3 (PRIOR ART)
FIG. 3 is a longitudinally sectional side view showing a conventional apparatus for adjusting a jaw gap of a jaw cylinder for a folder.

In FIGS. 1 and 2(*a*) to 2(*c*), reference numeral 30 denotes a jaw cylinder; 31, a jaw cylinder body; 32 and 33, shafts of the jaw cylinder body 31, which are rotatably supported by the frames 1*a* and 1*b*.

Reference numerals 34 and 35 denote bushes movably fitted to the shafts 32 and 33 of the jaw cylinder body 31; 36, a folding jaw support having folding jaw support plates 36*a* and 36*b* which are rotatably fitted to the shafts 32 and 33 through the bushes 34 and 35. Reference numeral 37 denotes a support rotating helical gear fixed to the folding jaw support 36; 38, a jaw cylinder driving helical gear meshing with the folding cylinder driving helical gear 25. The jaw cylinder driving helical gear 38 is fitted to the shaft 32 so as to be movable in the axial direction but non-rotatable.

Reference numeral 39 denotes a gap adjusting helical gear fixed to the jaw cylinder driving helical gear 38, which has a helical edge whose direction of a twist angle is the same as that of the jaw cylinder driving helical gear 38 and whose twist angle is twice as large as that of the gear 38.

Reference numeral 42 denotes a shaft fixed to the frame 1*a*; 41, an intermediate helical gear rotatably supported by the shaft 42; and 40, an intermediate helical gear fixed to the intermediate helical gear 41. The intermediate helical gear 41 meshes with the support rotating helical gear 37 whereas the intermediate helical gear 40 meshes with the gap adjusting helical gear 39.

Reference numeral 49 denotes a cover; 44, an actuator attached to the cover 49; 45, a pair of bevel gears meshing with each other; 45, a screw shaft rotatably attached to the cover 49. The rotational movement of the actuator 44 is transmitted to the screw shaft 46 through the pair of bevel gears 45 so as to make the screw shaft 46 rotate.

Reference numeral 47 denotes a block meshing with the screw shaft 46; 47', a bearing disposed between the block 47 and the boss portion of jaw cylinder driving helical gear 38; 48, a bar attached to the block 47 for guide and whirl-stop. The tip of the guide and whirl-stop bar 48 is inserted into an aperture of a bearing 50 attached to the cover 49 so as to be movable in a direction parallel to the axial direction of the screw shaft 46.

In FIGS. 1 and 2(*a*) to 2(*c*), reference numeral 51 denotes a shaft rotatably supported by the folding jaw support plates 36*a* and 36*b*; 11, a folding jaw swingably attached to the shaft 51; 15, a stationary jaw fixed to the jaw cylinder body 31; 52, an arm fixed to the shaft end of the shaft 51; 53, a cam follower eccentrically attached to the arm 52; 54, a cam fixed to the frame 1*b*. The shaft 51 is rotated by the cam 54 and the cam follower 53 brought in contact with the cam 54 when the jaw cylinder 30 is rotated, whereby the folding jaw 11 is swung between an open position and a close position.

In this embodiment, the jaw cylinder 30 is constituted by the above-mentioned parts 26 and 31 to 43. Reference numeral 43 denotes a jaw gap adjusting unit which is constituted by the above-mentioned parts 44 to 50. Reference numeral 26 denotes a pair of folding jaws which include the swingable folding jaw 11 and the stationary jaw 15 fixed to the jaw cylinder body 31.

Now, the operation of the apparatus for adjusting the jaw gap of the jaw cylinder for the folder as shown in FIGS. 1 and 2(*a*) to 2(*c*) will be described in more detail.

When the gap of the folding jaw 11 of the jaw cylinder 30 is adjusted, the actuator 44 of the jaw gap adjusting unit 43 is rotated so that the rotational movement of the actuator 44 is transmitted to the screw shaft 46 through the pair of bevel gears 45. As a result, the screw shaft 46 is rotated, causing the block 47, the bearing 47', the jaw cylinder driving helical gear 38 and the gap adjusting helical gear 39 to move in the axial direction of the screw shaft 46.

At this time, in the case where the folding cylinder driving helical gear 25 at the side of the folding cylinder 2 is driven by a helical gear (not shown) having relatively large rotating inertia, even though the jaw cylinder driving helical gear 38 is moved in the axial direction, the folding cylinder driving helical gear 25 at the side of the folding cylinder 2, the folding cylinder 2 and the folding blade 24 are not rotated, but the jaw cylinder driving helical gear 38 at the side of the jaw cylinder 30 having rotating inertia smaller than that at the side of the folding cylinder 2 and the gap adjusting helical gear 39 are rotated.

The rotational movement of the jaw cylinder driving helical gear 38 is transmitted to the jaw cylinder body 31 through the shaft 32 so as to make the jaw cylinder body 31 rotate, whereby the stationary jaw 15 fixed to the jaw cylinder body 31 is moved by an angle 0 counterclockwise, starting from the folding blade 24 of the folding cylinder 2, as shown in FIG. 2(*c*).

The rotational movements of the jaw cylinder driving helical gear 38 and the gap adjusting helical gear 39 are transmitted to the folding jaw support 36 through the intermediate gears 40, 41 and the support rotating helical gear 37, and then transmitted to the folding jaw support 36*a*, the shaft 51, the folding jaw support 36*b* and the folding jaw 11. As a result, these parts are rotated about the shafts 32 and 33. With the rotations of these parts, the cam follower 53 engaged with the cam 54 is axially rotated about the shaft 51 through the arm 52, thereby making the folding jaw 11 fixed to the shaft 51 rotate. That is, as shown in FIG. 2(*c*), the folding jaw 11 is rotated by 20 clockwise, starting from the stationary jaw 15. The above-description is analytic, and in fact, the stationary jaw 15 and the folding jaw 11 are simultaneously rotated by 0 counterclockwise and clockwise, starting from the folding blade 24.

In the case where a helical gear (not shown) at the side of the drive source allows the jaw cylinder driving helical gear 38 at the side of the jaw cylinder 30 is driven, the jaw cylinder driving helical gear 38 and the gap adjusting helical gear 39 (the gear 39 has the same direction of the twist angle as that of the jaw cylinder driving helical gear 38, and has the twist angle, for example, twice as large as that of the gear 38) are rotated with respect to the helical gear (not shown) at the drive source side.

The rotational movement of the jaw cylinder driving helical gear 38 is transmitted to the jaw cylinder body 31 through the shaft 32 so as to rotate the jaw cylinder body 31, as a result of which, as shown in FIG. 2(*b*), the stationary jaw 15 fixed to the jaw cylinder body 31 is moved by the angle θ counterclockwise, starting from the folding blade 24 of the folding cylinder 2.

The rotational movement of the gap adjusting helical gear 39 is transmitted to the intermediate gears 40, 41, the support rotating helical gear 37, the folding jaw support 36*a*, the shaft 51, the folding jaw support 36*b*, and the folding jaw 11, whereby these parts are rotated, and as shown in FIG. 2(*b*), the folding jaw 11 is rotated by 28 clockwise, starting from the stationary jaw 15. The above-description is analytic, and in fact, the stationary jaw 15 and the folding jaw 11 are rotated by θ counterclockwise and clockwise, starting from the folding blade 24, simultaneously.

As described above, even though any one of the folding cylinder driving helical gear 25 and the jaw cylinder driving helical gear 38 is driven, the folding blade 24 is always positioned in the center of the stationary jaw 15 and the folding jaw 11.

Since the folding cylinder 2 and the jaw cylinder 30 doubly fold folding products, the folding blade 24 is positioned in the center of the stationary jaw 15 and the folding jaw 11. However, depending upon a state of a front half or a rear half of the folding products held by a needle or a claw (not shown) of the folding cylinder 2, the twist angles of the gap adjusting helical gear 39 and the intermediate gear 40 or a timing of folding the folding blade 24 may be changed to slightly change the position of the folding blade 24.

The gap between the stationary jaw 15 and the folding jaw 11 is adjusted in accordance with the thickness of the folding products, and the gap adjustment is made by changing the rotational speed of the actuator 44 so as to alter the amount of movement of the screw shaft 46 in the axial direction thereof.

If the amount of movement of the screw shaft 46 in the axial direction thereof is detected by a position detecting sensor so as to be displayed on a display unit, and switching operation is made on the basis of the displayed result to control the rotational speed of the actuator 44, a remote control operation can be performed. Also, the stationary jaw 15 may be provided in the folding jaw supports 36*a* and 36*b*, and the folding jaw 11 may be provided in the jaw cylinder body 31. Further, the movement of the screw shaft 46 may be made by a manual handle, a thread-formed spindle, etc.

As described above, in the apparatus for adjusting the jaw gap of the jaw cylinder for the folder in accordance with the present invention, since two of the jaw cylinder driving helical gear and the gap adjusting helical gear having the same direction of the twist angle but the different twist angle are only provided so as to be movable in the axial direction by the adjusting unit, the above-mentioned conventional rotational direction reverse transmission unit with the complicated structure can be eliminated with the result that the number of parts can be reduced and the costs can be lowered.

Furthermore, since it is unnecessary to provide, in the jaw cylinder, the above-mentioned conventional rotational direction reverse transmission unit with the complicated structure, a gap between the frames for rotatably supporting the jaw cylinder can be shortened, and the overall folder can be made compact, as a result of which an installation space can be saved.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An apparatus for adjusting a jaw gap of a jaw cylinder for a folder in which a folding blade of a folding cylinder is inserted between a pair of folding jaws provided in a jaw cylinder to doubly fold a folding product held on an outer peripheral surface of a folding cylinder, said apparatus comprising:

a folding jaw support (36) provided concentrically with a shaft (32) of said jaw cylinder (30), one of said pair of folding jaws (11, 15) being fitted to said folding jaw support (36), the other of said pair of folding jaws (11, 15) being fitted to a jaw cylinder body (31);

a jaw cylinder driving helical gear (38) attached to said shaft (32) of said jaw cylinder (30) to be movable in an axial direction thereof but non-rotatable;

a gap adjusting helical gear (39) fixed to said jaw cylinder driving helical gear (38) and having a helical edge with a same direction of a twist angle and the twist angle 18 larger than those of said jaw cylinder driving helical gear (38);

a support rotating helical gear (37) attached to said folding jaw support (36);

intermediate gears (40, 41) coupling said gap adjusting helical gear (39) with said support rotating helical gear (37); and an adjusting unit (43) provided on a fixed member of said folder for moving said jaw cylinder driving helical gear (38) in the axial direction.

2. An apparatus for adjusting a jaw gap of a jaw cylinder for a folder wherein a folding blade of a folding cylinder as claimed in claim 1, wherein said folding jaw support (36) includes folding jaw support plates (36*a*, 36*b*) disposed on both sides of said jaw cylinder body (31); and said apparatus further comprising a shaft (51) rotatably supported by said folding jaw support plates (36*a*, 36*b*), one of said folding jaws (11, 15) being attached to said shaft (51); and a folding jaw open/close means including a cam follower (53) coupled with said shaft (51) and a cam (54) fixed to a frame.

3. An apparatus for adjusting a jaw gap of a jaw cylinder for a folder in which a folding blade of a folding cylinder as claimed in claim 1, wherein said adjusting unit (43) includes a screw shaft (46) and a block (47) meshing with said screw shaft (46) and displaced in the axial direction by rotation of said screw shaft (46), said block (47) being coupled with said helical gear (38) so as not to be relatively moved in the axial direction.

4. An apparatus for adjusting a jaw gap of a jaw cylinder for a folder in which a folding blade of a folding cylinder as claimed in claim 2, wherein said adjusting unit (43) includes a screw shaft (46) and a block (47) meshing with said screw shaft (46) and displaced in the axial direction by rotation of said screw shaft (46), said block (47) being coupled with said helical gear (38) so as not to be relatively moved in the axial direction.

* * * * *